US006005954A

United States Patent [19]

Weinfurtner

[11] Patent Number: 6,005,954

[45] **Date of Patent: *Dec. 21, 1999**

[54] HEARING AID HAVING A DIGITALLY CONSTRUCTED CALCULATING UNIT EMPLOYING FUZZY LOGIC

[75] Inventor: Oliver Weinfurtner, Fishkill, N.Y.

[73] Assignee: Siemens Audiologische Technik GmbH, Erlangen, Germany

[ * ] Notice: This patent is subject to a terminal disclaimer.

[21] Appl. No.: 08/864,063

[22] Filed: May 28, 1997

[30] Foreign Application Priority Data

Jun. 21, 1996 [EP] European Pat. Off. ..... 96110068

[51] Int. Cl.[6] ..... H04R 25/00

[52] U.S. Cl. ..... 381/312; 381/314; 381/320; 381/321

[58] Field of Search ..... 381/312, 320, 381/321, 60, 106, 107, 108, 71.12, 314

[56] References Cited

U.S. PATENT DOCUMENTS

| | | | |
|---|---|---|---|
| 5,361,325 | 11/1994 | Takahashi | 395/3 |
| 5,604,812 | 2/1997 | Meyer | 381/68.2 |
| 5,606,620 | 2/1997 | Weinfurtner | 381/68.2 |
| 5,636,285 | 6/1997 | Sauer | 381/68.2 |
| 5,706,351 | 1/1998 | Weinfurtner | 381/68.2 |

FOREIGN PATENT DOCUMENTS

| | | |
|---|---|---|
| 0 674 463 | 9/1995 | European Pat. Off. . |
| 0 674 464 | 9/1995 | European Pat. Off. . |
| OS 44 39 505 | 5/1996 | Germany . |
| WO 93/05471 | 3/1993 | WIPO . |

*Primary Examiner*—Curtis A. Kuntz
*Assistant Examiner*—Phylesha Dabney
*Attorney, Agent, or Firm*—Hill & Simpson

[57] ABSTRACT

A hearing aid has an input transistor, an amplifier and transmission circuit, an output transducer and a calculating unit that realizes fuzzy logic functions. The calculating unit responds to a tap signal taken at the amplifier and transmission circuit and supplies an event signal that is supplied to the amplifier and transmission circuit and influences an output signal emitted thereby. At least the calculating unit is implemented in digital circuit technology. Such a hearing aid can be manufactured with little development and circuit outlay, operates reliably and enables an optimum matching to the specific requirements of the hearing aid user.

10 Claims, 12 Drawing Sheets

HEARING AID HAVING A DIGITALLY CONSTRUCTED CALCULATING UNIT EMPLOYING FUZZY LOGIC

BACKGROUND OF THE INVENTION

1. Field of the Invention

The present invention is directed to a hearing aid having a calculating unit which operates on one or more signals in order to produce or set operating parameters for the amplifier and transmission stage in the hearing aid, connected between the input and output.

As used herein "signal" means the curve of one or more physical quantities and one or more measuring points over time; each signal can thus be composed of a bundle of individual signals.

2. Description of the Prior Art

European Application 0 674 464, corresponding to U.S. Pat. No. 5,606,620, discloses a hearing aid of the above type wherein a fuzzy logic controller is provided in order either to modify the signal transmission characteristic of an amplifier and transmission means or to automatically select a set of parameters from a parameter memory that influence the signal transmission characteristic.

European 0 674 463, corresponding to U.S. Pat. No. 5,717,770, discloses a similar hearing aid wherein an automatic gain control (AGC) circuit has a fuzzy logic controller allocated to it.

The hearing aids disclosed in these published applications, however, only provide a realization of fuzzy logic functions in analog circuit technology. A problem of a high circuit-oriented outlay arises therefrom, this being especially disadvantageous because of the miniaturization required in hearing aids.

SUMMARY OF THE INVENTION

An object of the present invention is to provide a solution in a hearing aid to the aforementioned problem. In particular, an object is to offer a hearing aid that can be manufactured with low development and circuit outlay and thereby enables an optimum matching to the specific requirements of the hearing aid user.

This object is inventively achieved in a hearing aid wherein at least the calculating means, in a hearing aid of the type described above is implemented in digital circuit technology.

A digital structure of a calculating means that realizes fuzzy logic functions offers a high degree of compatibility with the digital signal processing: an additional conversion (analog-to-digital or digital-to-analog) is not required and the calculating means can be entirely or partially realized with the same components as the remaining processing of the signals. An easy combination of the calculating means with conventional digital data and signal processing functions arises therefrom as are standard, for example, in microprocessors and signal processors. Moreover, the digital technology offers advantages such as enhanced resistance to noise and insensitivity to fabricating tolerances.

The calculating means is preferably fashioned with standard digital components such as gates, flip-flops, memories, etc.; more generally with combinational logic systems and sequential logic systems. In particular, it can be fashioned as an ASIC (application specific integrated circuit). Alternatively, it is possible to fashion the calculating means as microprocessor or microcontroller with an appertaining program that is stored in a read-only memory (ROM) particularly a mask-programmed ROM, PROM, EPROM or EEPROM or a random-access memory (RAM). Mixed forms are also possible; for example, specific hard-wired modules can be connected to a programmed control. This is particularly meaningful for functions that must be implemented often and that can be digitally realized in a relatively simple way, for example for functions for calculating the maximum or minimum of a quantity of binary numbers.

In the inventive hearing aid, the calculating means is preferably utilized for the direct signal processing and/or for the control of signal processing functions and/or for the automatic selection of auditory programs in the hearing aid.

Further, the calculating means of the hearing aid realizes the fuzzy logic functions preferably by executing the substeps of defuzzification of sharp input variables, evaluation of premises, evaluation of sub-conclusions, accumulation of output terms and defuzzification. The calculations required therefor are preferably distributed among a plurality of calculating modules that can have local or shared memories.

Configuration parameters of the calculating means are preferably stored in a memory, for example a RAM or EEPROM, so that a re-programming of the calculating means by the hearing aid audiologist and/or even an adaptation of the function of the calculating means during operation of the hearing aid is possible.

DESCRIPTION OF THE PREFERRED EMBODIMENTS

Figure 1:
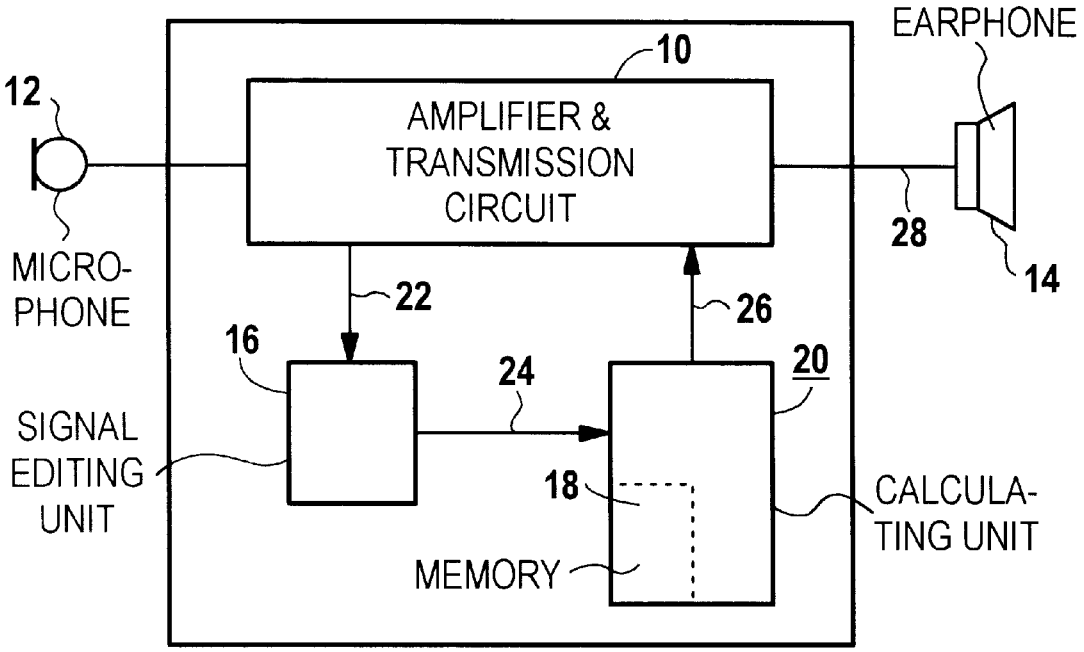
FIG. 1 is a block circuit diagram of a hearing aid constructed in accordance with the principles of the present invention.

In the hearing aid schematically shown in FIG. 1, a microphone acting as an input transducer 12 converts an acoustical signal into an electrical signal and conducts the electrical signal to an amplifier and transmission circuit 10. The amplifier and transmission circuit 10 amplifies the incoming signal and processes it, for example by selective boosting or attenuation of specific frequency or volume ranges. The output signal 28 processed in this way is emitted via an earphone serving as an output transducer 14.

A tap signal 22 is taken at at least one suitable location of the amplifier and transmission circuit 10 from the signal path of the hearing aid and is supplied to a signal editing unit 16. The tap signal 22 can also be individual signals that are derived from other input transducers, from operating elements or from sensors for monitoring system properties (for example, the battery voltage).

The signal editing unit 16 suitable edits the tap signal 22 for example by rectification, averaging or time differentiation, in order to supply it as an input signal 24 to a calculating unit 20 that realizes the fuzzy logic functions. Details of the fashioning of the signal editing unit 16 as well for a description of the individual signals from which the tap signal 22 is composed, the teachings of European Application 0 674 464 and its counterpart U.S. Pat. No. 5,606,620, are incorporated herein by reference.

The calculating unit 20 includes a memory 18 that stores intermediate results as well as, possibly, configuration parameters of the calculating unit 20. The calculating unit 20 processes the input signal 24 supplied to it in the way described in greater detail below according to the principles of fuzzy logic and emits the result as event signal 26 to the amplifier and transmission circuit 10, whose amplification and transmission properties are variable within broad limits on the basis of the event signal 26, acting as a control signal.

Only the calculating means 20 is digitally implemented in one embodiment of the invention, whereas the other assemblies—except for analog-to-digital and digital-to-analog converters which may be required—are formed as analog circuits. In an alternative embodiment, however, the amplifier and transmission circuit 10, the signal editing unit 16 and the calculating unit 20 are executed substantially digitally, and the tap signal 22, the input signal 24 and the event signal 26 are digital signals that are preferably transmitted in parallel on a number of lines as successive binary numbers. In this alternative embodiment, only the amplifier and transmission circuit 10 has an analog-to-digital converter for the signal derived from the input transistor 12 and a digital-to-analog converter that generates the output signal 28 conducted to the output transducer 14.

In the embodiment of the inventive hearing aid shown in FIG. 1, the event signal 26 controls the transmission characteristic of the amplifier and transmission circuit 10 directly by setting individual parameters of the amplifier and transmission circuit 10, for example the gain of specific frequency bands or response and decay times of an automatic gain control (AGC).

In an alternative embodiment, the amplifier and transmission circuit 10 has a memory that contains a number of preset or programmed-in parameter sets. A parameter set of this memory is selected based on the event signal 26, for example by the digital event signal 26 serving as a memory address signal.

In a further alternative embodiment, the amplifier and transmission circuit 10 does not have a direct signal path proceeding directly from input transducer 12 to output transducer 14. Instead, the signal path proceeds from the input transducer 12 via a first part of the amplifier and transmission circuit 10 to the signal editing unit 16, from the latter to the calculating unit 20, and—as event signal 26—to a second part of the amplifier and transmission circuit 10, and from the latter as output signal 28 to the output transducer 14. The digital event signal is merely converted into an analog signal and, may possibly be, filtered in the second part of the amplifier and transmission means 10.

The fuzzy logic employed in the inventive hearing aid allows the processing of signals and information according to unsharp rules, what is referred to as a rule set. For example, this rule set can be as follows:

Rule 1: IF (A is big) AND (B is big)
THEN (X is big) AND (Y is big)

Rule 2: IF (A is small) OR (B is big)
THEN (X is small)

Rule 3: IF (A is small) AND (B is small)
THEN (X is small) AND (Y is small)

The expression between IF and THEN is referred to as a premise; the expression to the right of THEN is referred to as a conclusion The sub-expressions in parentheses are correspondingly referred to as sub-premises and sub-conclusions.

The individual sub-functions of the calculating unit 20 are explained in greater detail with reference to the example of this rule set.

Figure 2:
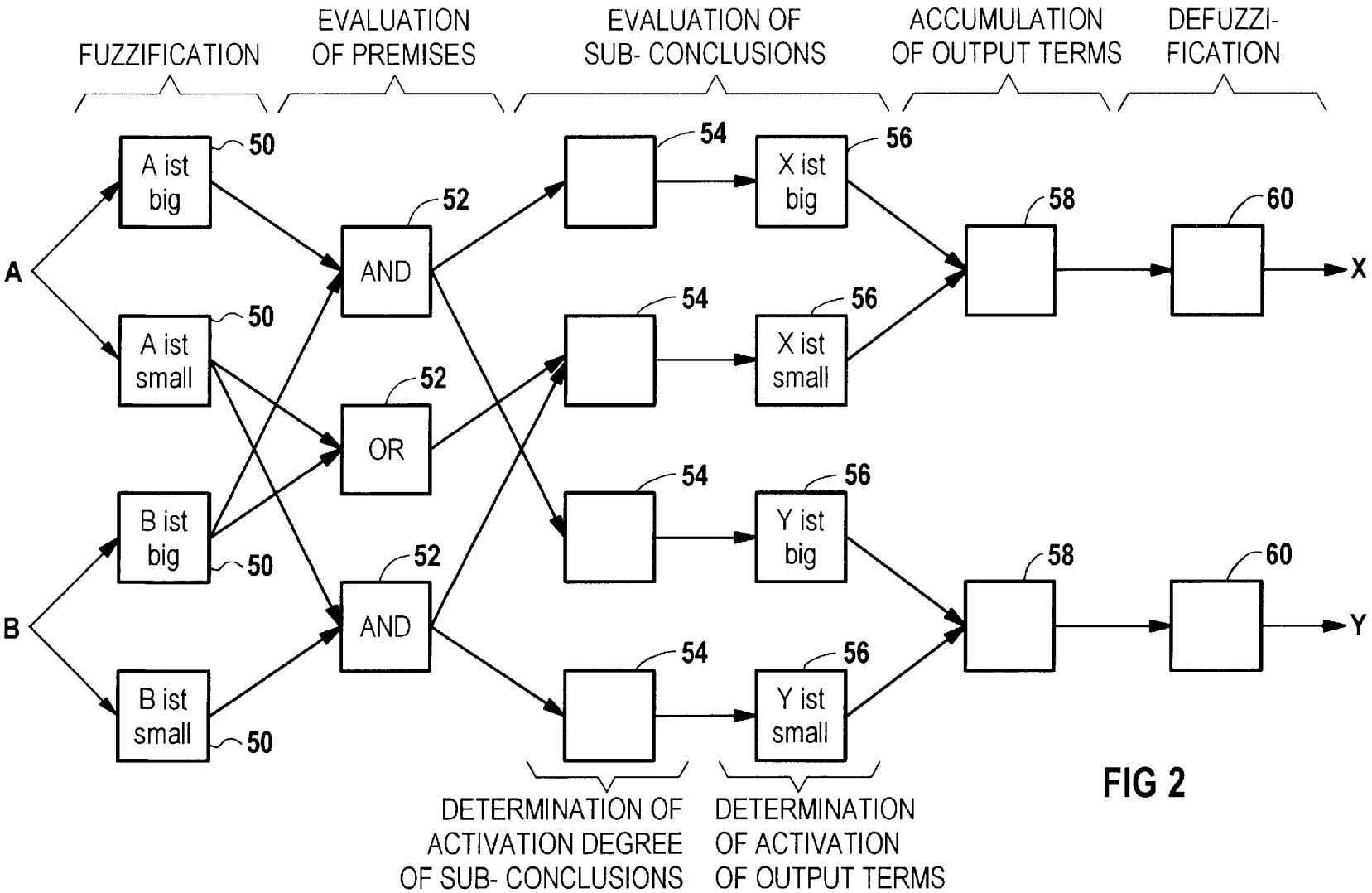
FIG. 2 is a conceptual presentation of an exemplary processing structure.

FIG. 2 shows the conceptual structure of the processing of the above rule set. It is composed of the following, basic sub-functions:

1) Fuzzification 50 of the sharp input variables. At the same time, the satisfaction content of the sub-premise is thereby determined.

2) Evaluation 52 of the premises, i.e., determination of the satisfaction content of the premises.

3) Evaluation of the sub-conclusions, i.e., determination of the activation of the sub-conclusions. In the illustration of FIG. 2, this step is divided into the two sub-steps of determination 54 of the activation degree of the sub-conclusions and determination 56 of the activation of the terms of the output variables.

4) Accumulation 58 of the output terms, i.e., determination of the activation of the conclusions.

5) Defuzzification 60 of the activated conclusions. Sharp output variables are thereby again defined.

In the inventive, digital realization of the calculating unit 20, the structure shown in FIG. 2 serves only for the conceptual presentation of a fuzzy logic calculation because, in the actual implementation, an arbitrary allocation of the sub-functions shown in FIG. 2 can ensue to one or more modules of the calculating unit 20.

Step 1)—Fuzzification of the input variables.

The value a membership function of each and every linguistic term of the corresponding linguistic variables has in the current value of the input variables is determined in the fuzzification.

Figure 3:
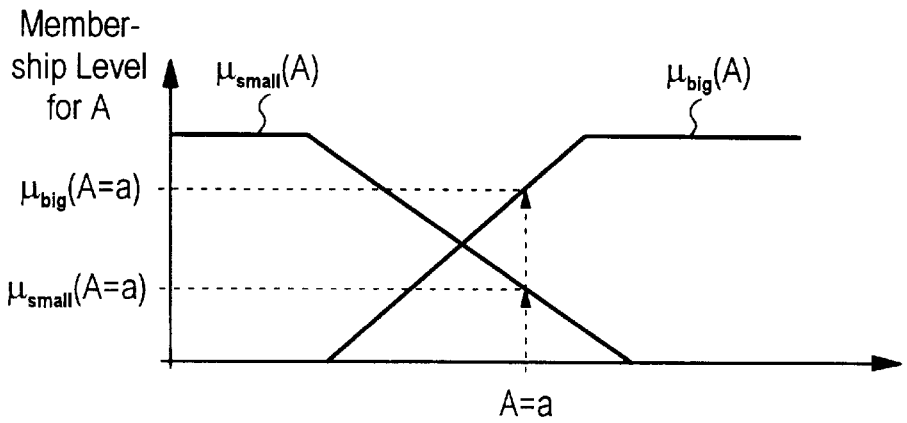
FIGS. 3*a* and 3*b* are graphs of membership functions for explaining the fuzzification.
Figure 3:
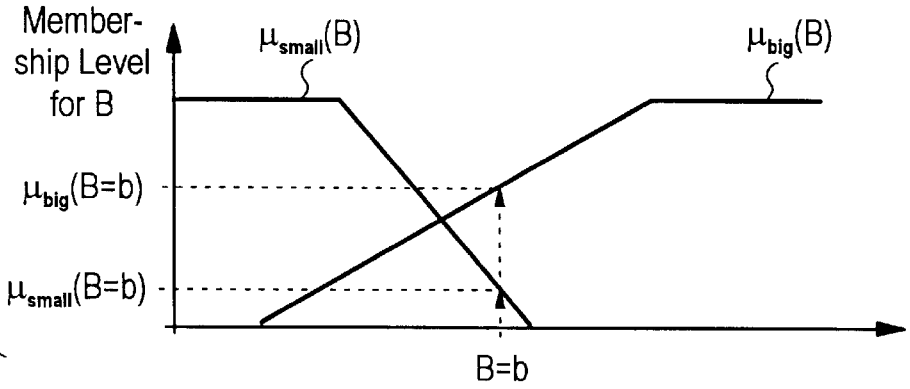

This is shown as an example in FIG. 3. The exemplary rule set contains two linguistic variables A and B, each with two linguistic terms, namely (A is small), (A is big) and (B is small), (B is big). The graphs shown in FIG. 3 represent the membership functions of these terms: $\mu_{small}(A)$, $\mu_{big}(A)$ and $\mu_{small}(B)$, $\mu_{big}(B)$. The input values a and b are imaged onto the corresponding values $\mu_{small}(A=a)$, $\mu_{big}(A=a)$ and $\mu_{small}(B=b)$, $\mu_{big}(B=b)$ of the membership functions.

The exemplary membership functions shown in FIGS. 4*a* through 4*c* and 5*a* through 5*e* can be divided into three classes:

Completely arbitrary curve of the membership function (FIG. 4*a*); as in the following classes as well, a limitation exists only due to the quantization of the curves. Each membership function—corresponding to the quantization applied—must be stored in the form of its discrete values. This is relatively memory-consuming. The further-processing is also calculation-intensive.

Linear curve of the function value between arbitrarily reciteable corner values (FIGS. 4*b* and 5*a*). a reduced memory and calculating outlay derives as a result of this limitation. Corresponding to the number M of corner values, each membership function can be presented as a sequence of x-y value pairs ($x_1$, $y_1$, $x_2$, $y_2$, . . . , $x_M$, $y_M$).

Linear curve of the function value between the maximum of four corner values for whose ordinate values only 0 and 1 are permitted. All curves thus possible are shown in FIG. 4*c*: left shoulder function 72, trapezoidal function 70, triangular function 74, right shoulder function 76. This limitation yields an optimum reduction of the memory outlay. Since a maximum of four corner values are present and only 0 and 1 are employed as y-values, each membership falling into this class can be unambiguously described on the basis of only its four x-values ($x_1$, $x_2$, $x_3$, $x_4$). This is shown for the trapezoidal function 70 in FIG. 5*b*, for the left-hand shoulder function 72 in FIG. 5*c* ($x_1$=$x_2$ applies here); for the triangular function 74 in FIG. 5*b* ($x_2$=$x_3$ applies here); and for the right-hand shoulder function 76 in FIG. 5*e* ($x_3$=$x_4$ applies here).

In order to be able to calculate the satisfaction degree of the sub-premises in the fuzzification, each input value is normed to the internally employed abscissa before beginning the fuzzification. It is assumed below that the input values are already normed.

Figure 4A:
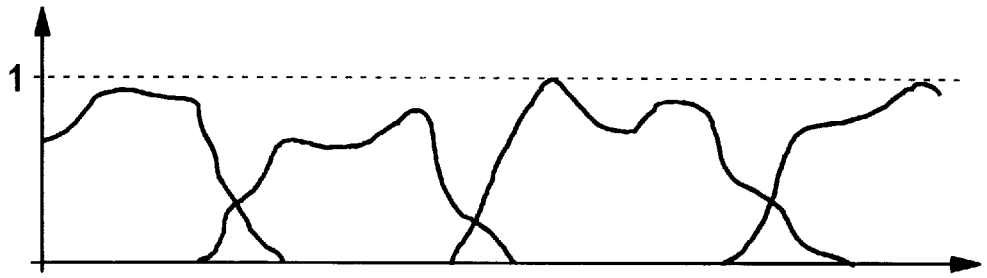
FIGS. 4*a*–4*c* are graphs of exemplary membership functions.

In the case of the free curve of the membership function shown in FIG. 4*a*, the determination of the satisfaction degree ensues by reading out the y-value allocated to the corresponding x-value from the memory.

Figure 4B:
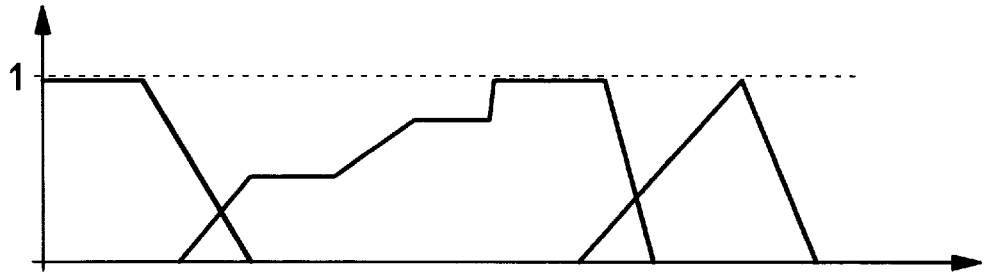
Figure 4C:
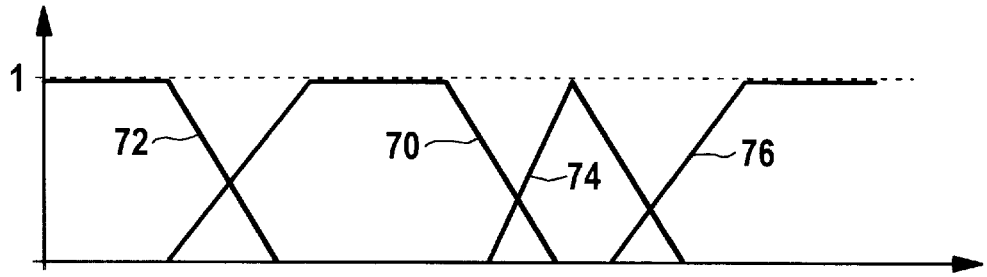
Figure 5A:
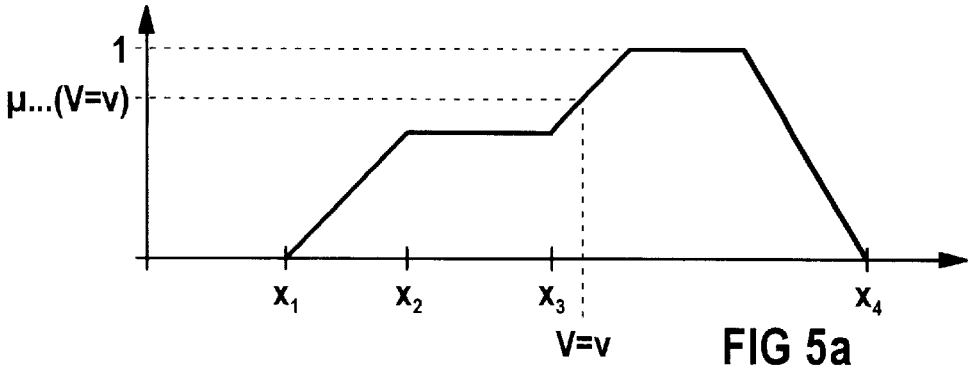
FIGS. 5*a*–5*e* are graphs of exemplary membership functions.
Figure 5B:
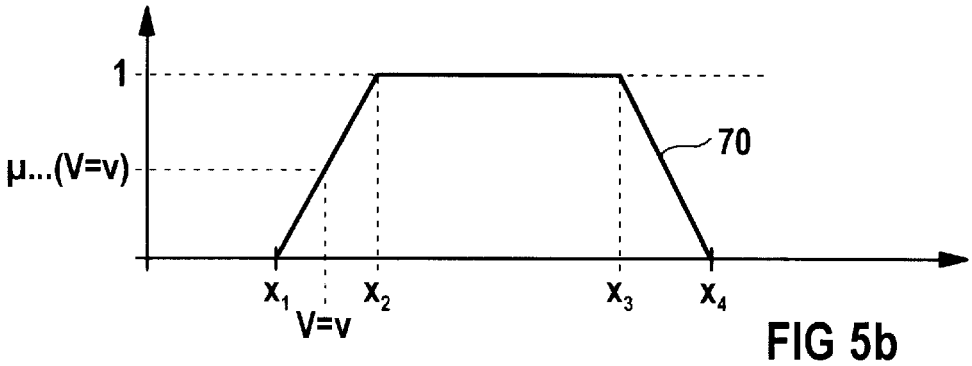
Figure 5C:
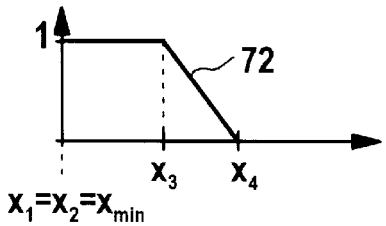
Figure 5D:
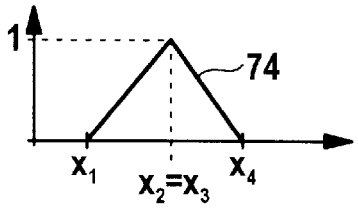
Figure 5E:
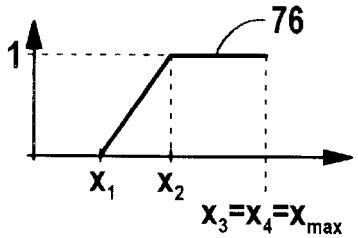

Given the linearized membership function shown in FIG. 4*b* and in FIG. 5*a*, the value of the membership function $\mu$ . . . (V=v) is to be determined according to the following rule:

1. When V<$x_1$, then $\mu$ . . . (V=v)=0.
2. When all values $x_m$=$x_2$, . . . $x_M$ until $x_M$>V applies, then calculate the satisfaction value according to the rule $$\mu \ldots (V - v) = Y_{m-1} + \frac{y_m - y_{m-1}}{x_m - x_{m-1}} * (V - x_{m-1})$$

and execute the run.

3. If this condition has never been satisfied given the above run, $\mu$ . . . (V=v)=0.

If a negated variable occurs in the control unit, then the value of the inverse membership function is to be determined. This is calculated from the value of the non-inverted membership function, as:

$$inv[\mu \ldots (V=v)] = 1 - \mu \ldots (V=v).$$

In the case of the greatest simplification of the membership functions shown in FIG. 4*c* and FIG. 5*b* through FIG. 5*e*, the calculating rule—that is also likewise simpler—for the value of the membership function $\mu$ . . . (V=v) is:

1. If V<$x_1$, then $\mu$ . . . (V=v)=0[1].
2. When $x_x$>V, then the satisfaction degree is calculated according to the rule $$\mu \ldots (V = v) = \frac{V - x_1}{x_2 - x_1}\left[\frac{x_2 - V}{x_2 - x_1}\right]$$

3. When $x_3$>V, then $\mu$ . . . (V=v)=1[0].
4. When $x_4$>V, then the satisfaction degree is calculated according to the rule $$\mu \ldots (V = v) = \frac{x_4 - V}{x_4 - x_3}\left[\frac{V - x_3}{x_4 - x_3}\right]$$

5. If this condition is not satisfied, then $\mu$ . . . (V=v)=0[1] applies.

If a negated variable occurs in the control unit, then the value of the inverse membership function is to be determined according to the above-recited equation. Optionally, the values indicated above in square brackets can be employed in the calculation.

Step 2)—Evaluation of the premises

The values of the membership functions calculated in Step 1), which correspond to the satisfaction degrees of the sub-premises (A is big), (B is big), etc., are operated on in the exemplary control unit employed here by linguistic AND and OR operators to form the premises of the individual rules.

Figure 6:
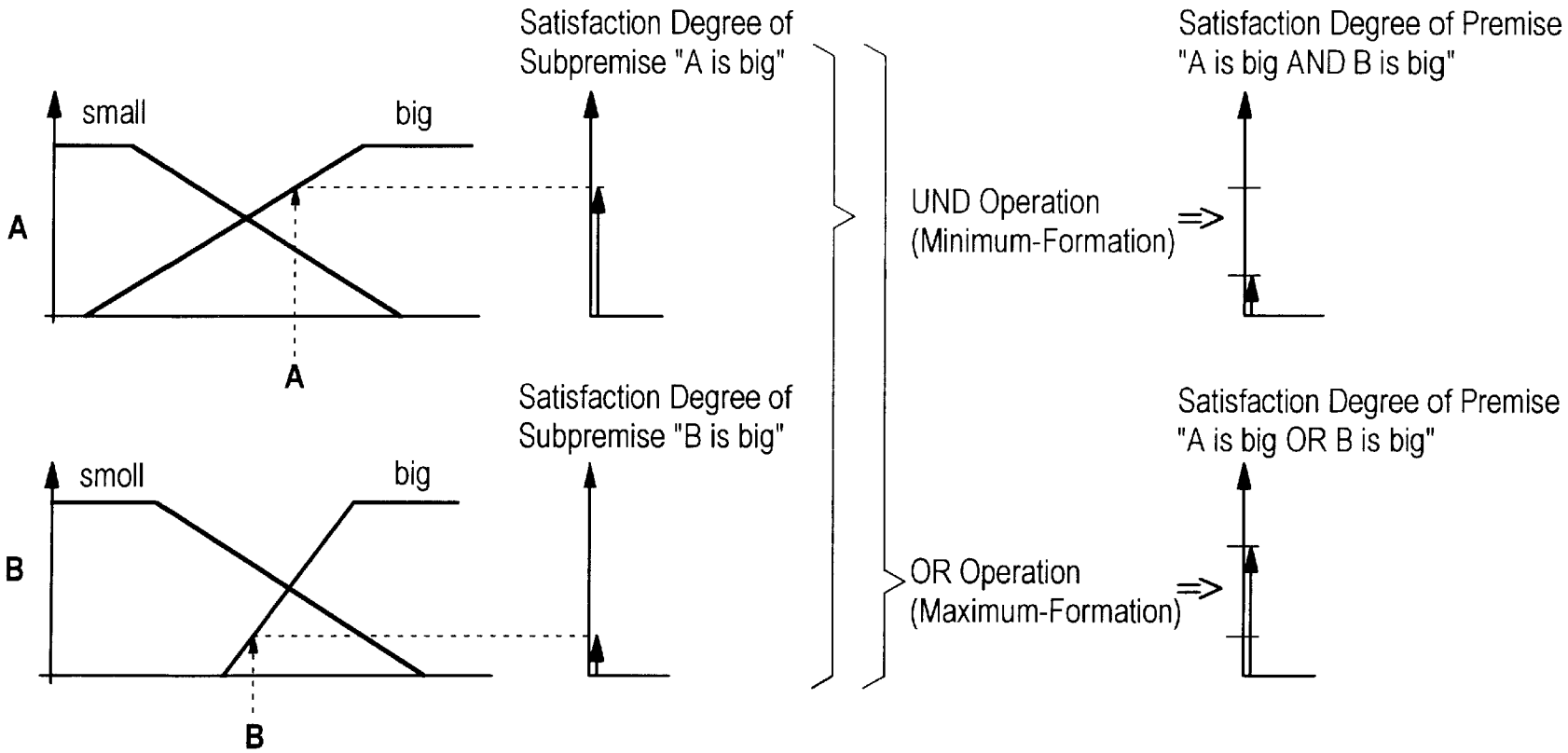
FIG. 6 is an illustration showing the evaluation of premises.

The calculation of the AND and OR operations of the sub-premises preferably occurs by the calculation of the minimum or the maximum of the corresponding satisfaction degrees, as shown in FIG. 6. The result of this operation is the satisfaction degree of the respective premises [(A is big) AND (B is big)], [(A is big) OR (B is big)], etc. This calculation ensues for all rules.

Step 3)—Evaluation of the sub-conclusions

For the evaluation of a sub-conclusion, the activation degree of the sub-conclusion is determined in a first sub-step. Each sub-conclusion is activated to the extent to which the premises allocated to it in the control unit are satisfied.

Figure 7:
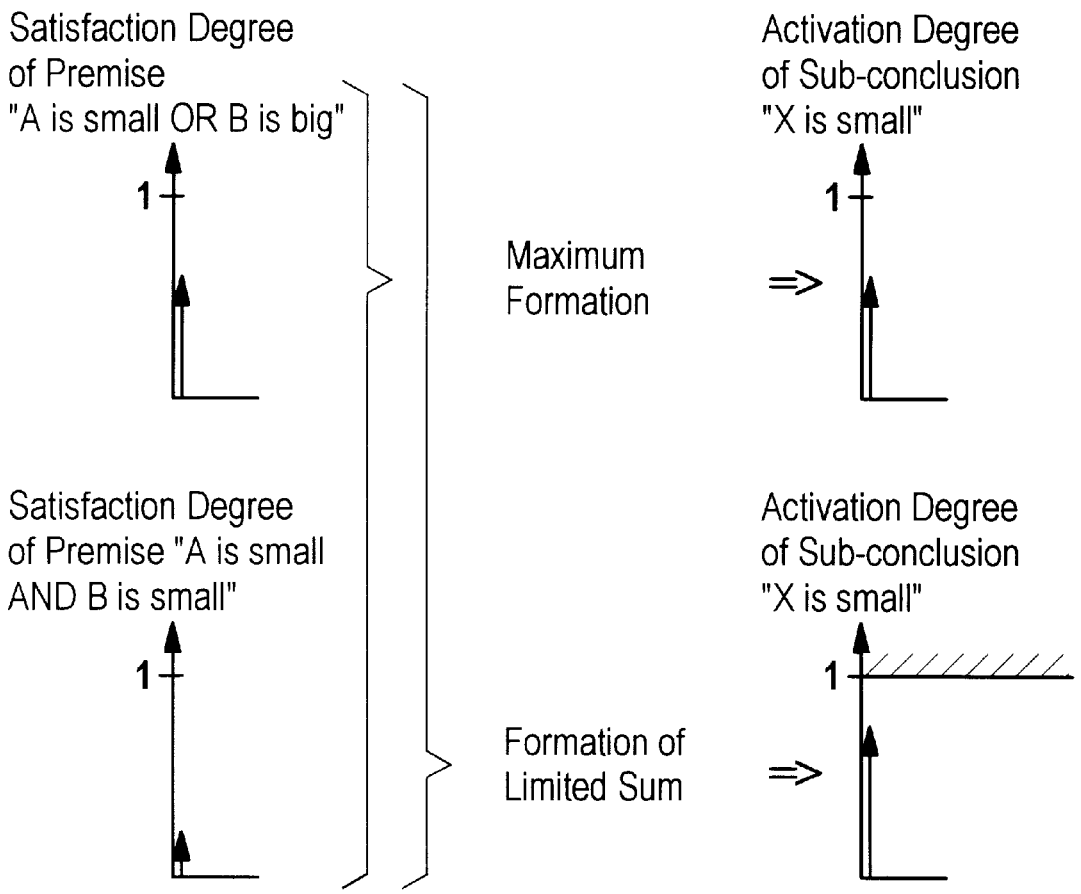
FIG. 7 is an illustration of two possibilities for determining the activation degree of a sub-conclusion.

If a sub-conclusion is mentioned only once in the control unit, its activation degree is equal to the satisfaction degree of the corresponding premise. If a sub-conclusion is mentioned in a number of rules, its activation degree is thus dependent on a number of premises, then the activation degrees of the appertaining premises must be calculated with one another in a suitable way. The two possibilities shown in FIG. 7 thereby particularly arise:

Formation of the maximum of the satisfaction degrees of the premises, or

Formation of the sum (limited to 1) of the satisfaction degrees of the premises.

The result of this operation is the activation degree of the sub-conclusion. This calculation ensues for all sub-conclusions.

Figure 8:
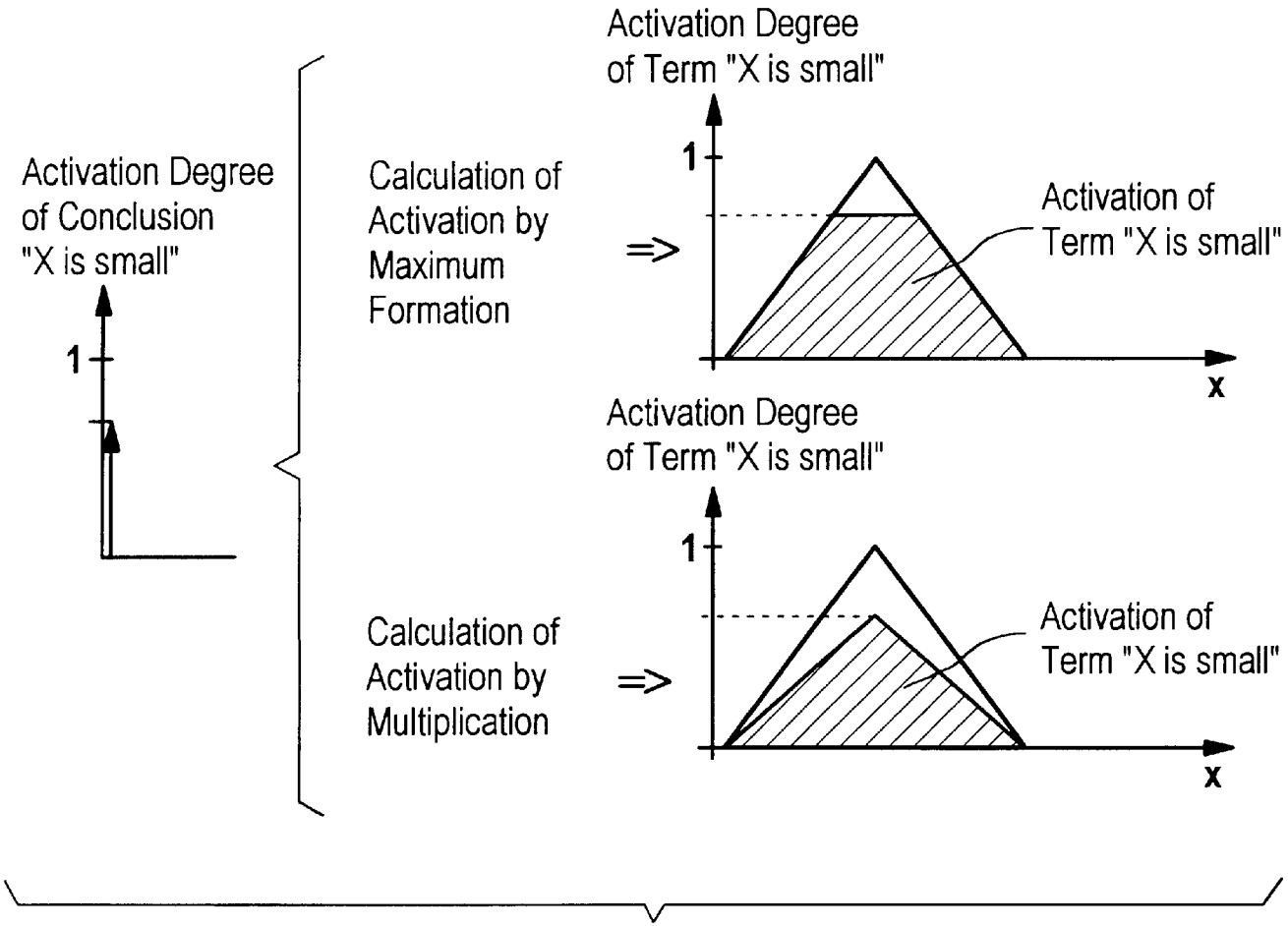
FIG. 8 is an illustration of two possibilities for defining the activation of a term.

In a second sub-step of the evaluation of the sub-conclusions, the activations of the terms of the output variables is determined. Each sub-conclusion activates a corresponding term of an output variable. These terms are described by their membership functions. Their activation, i.e., the extent to which they currently take effect, corresponds to a sub-surface under this membership function. This sub-surface is in turn defined by the activation degree (determined in the first sub-step) of the sub-conclusion. One of the two methods shown in FIG. 8 is preferably employed in order to determine the activation of the corresponding term from the activation degree of a sub-conclusion:

Limitation of the maximum values of the membership function to the value of the activation degree, or Multiplication of the curve of the membership function by the value of the activation degree.

This calculation occurs for all terms of all output variables.

Step 4)—Accumulation of the output terms

Figure 9:
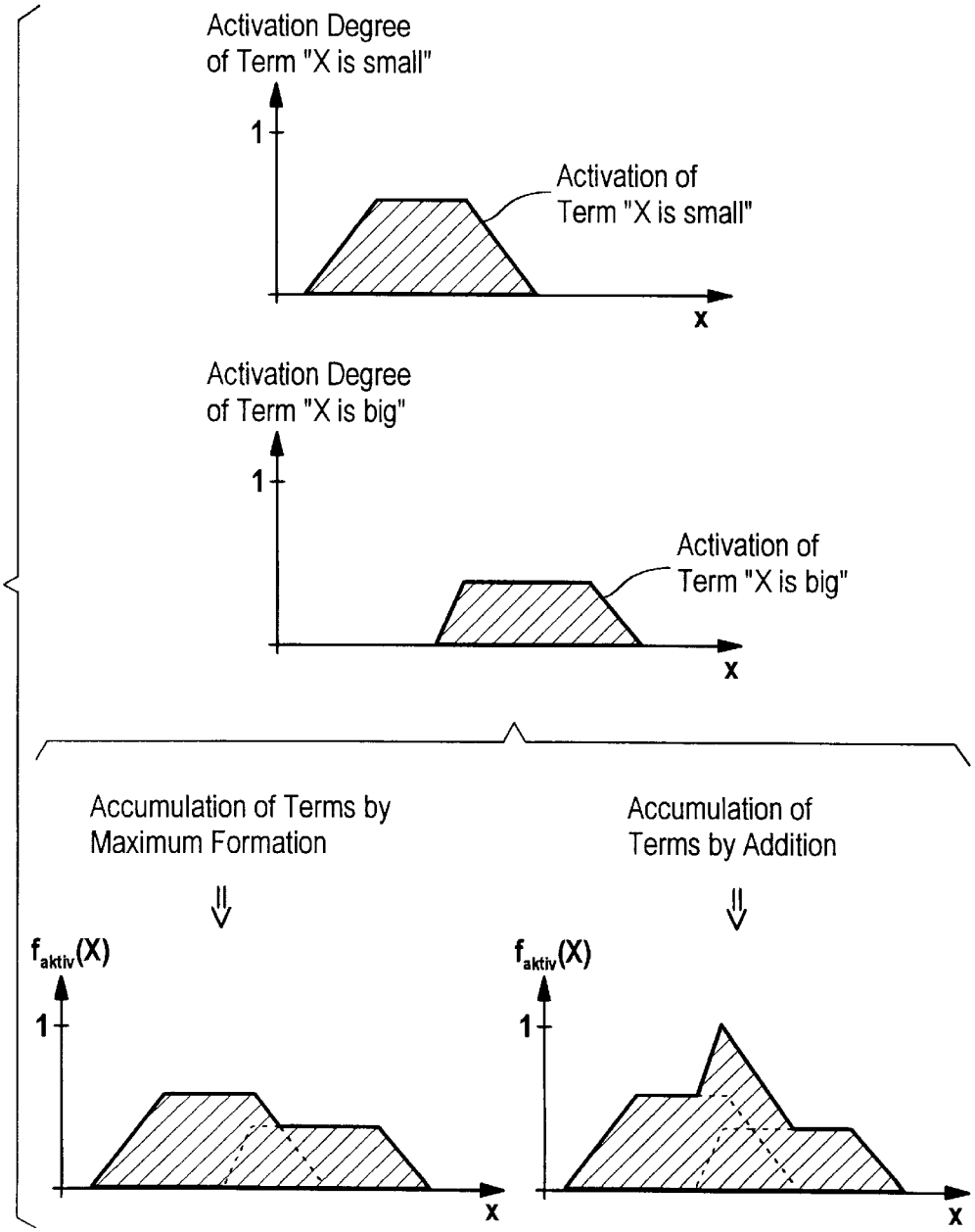
FIG. 9 is an illustration of two possibilities for the accumulation of output terms.

Each linguistic output variable is usually composed of a number of terms. The activation has now been determined for each of these terms. The individual, activated terms of each output variable must now be superimposed (accumulated) in suitable way. The two methods shown in FIG. 9 are thereby preferably employed:

Formation of the maximum of the function curves for each abscissa value surrounding the activated terms, or Addition of the function curves for each abscissa value surrounding the activated terms.

This accumulation occurs for each output variable.

Step 5)—Defuzzification

As a result of the defuzzification, a sharp output value is determined from the accumulated terms of each and every output variable. The operation of the defuzzification is thus applied to every output variable. The following two methods thereto are possible:

Determination of the average of the maximums (FIG. 10), or

Figure 11:
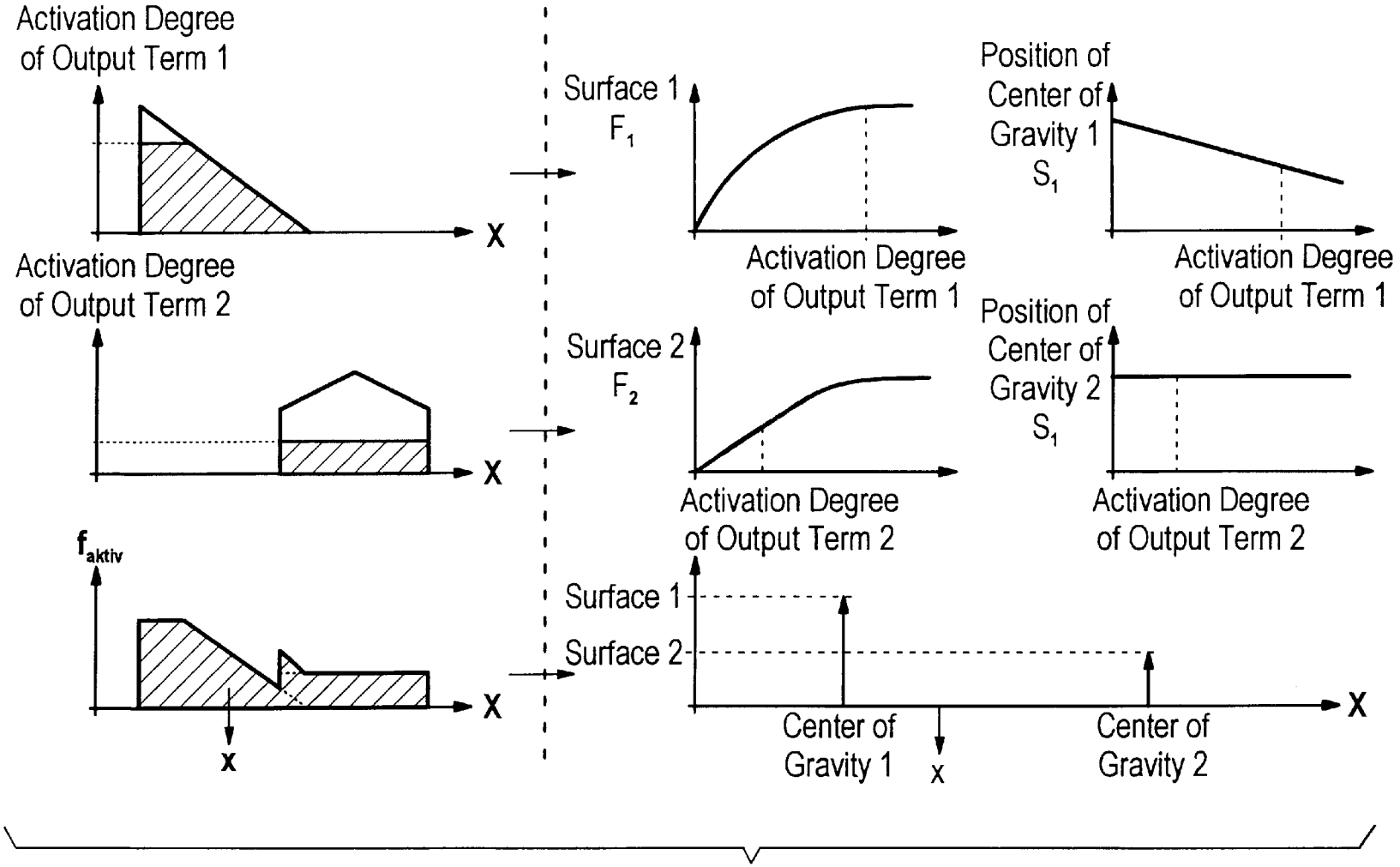
FIG. 11 is an illustration showing a second method for defuzzification as well as an outlay-reduced method in the inventive hearing aid.

Determination of the center of gravity (FIG. 11).

Figure 10:
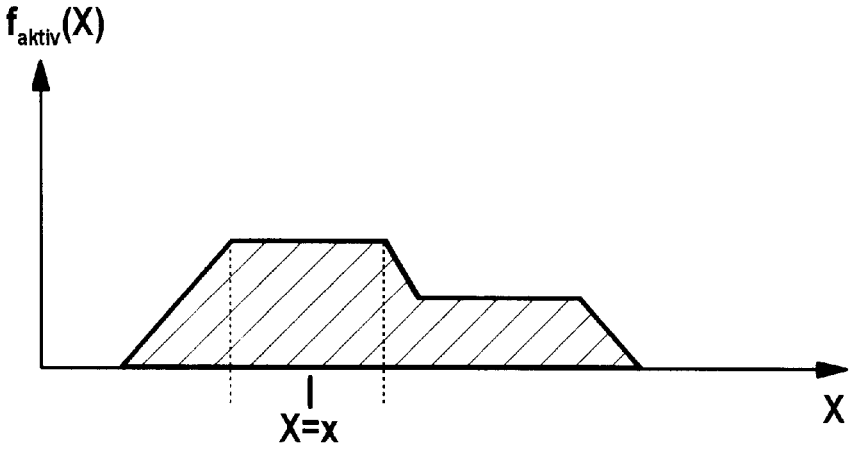
FIG. 10 is an illustration showing a first method for defuzzification in the inventive hearing aid.

Given the type of defuzzification shown in FIG. 10 by determining the average of the maximums, the sharp output value x is calculated as average of the positions of the maximums of $F_{active}(X)$.

Given the center of gravity method illustrated in FIG. 11, the following calculating procedure is applied to the accumulated terms of each and every output variable for calculating the sharp output value x:

$$X = \frac{\int_{X_{\min}}^{X_{\max}} X * f_{active}(X) * dX}{\int_{X_{\min}}^{X_{\max}} f_{active}(X) * dX}$$

This corresponds to the calculation of the x-component of the center of gravity of the surface.

Given a digital realization of the calculation, the integrations are to be replaced by sum formations. Then valid is:

$$X = \frac{\sum_{X_{\min}}^{X_{\max}} X * f_{active}(X)}{\sum_{X_{\min}}^{X_{\max}} f_{active}(X)}$$

In order to shorten the calculation, the range over which integration or summation is carried is preferably limited to the interval between $X_{min}$ and $X_{max}$; i.e., to the interval between the smallest and biggest X-value for which $f_{active}(X)>0$ applies. This information arises in the accumulation of the output terms.

The method described below allows an outlay-reduced calculation of the steps from the activation of the terms of the output variables to the defuzzification.

When the activation of the appertaining output term is determined from the activation degree of the conclusion, then this operation can be described by two imaging functions: the activation degree of the conclusion is imaged, first, onto the activated surface $F_n$ of the output term and, second, it is imaged onto a center of gravity position $S_n$ of this activated surface. Both imaging rules need not be evaluated during the running time of the system since they are only dependent on the output terms and on the method shown in FIG. 8 for converting the activation degree of the conclusion into the activation of the terms (maximum formation or multiplication).

FIG. 11 illustrates the described transition to two separate imaging rules. The accumulation of the output terms and the defuzzification now occur simultaneously implementing the calculation rule:

$$x = \frac{\sum_{n=1}^{N} S_n * F_n}{\sum_{n=1}^{N} F_n}$$

for each output variable. N thereby stands for the plurality of terms of the output variables. In the example shown in FIG. 11, an overall center of gravity thus derives as $$x=(S_1*F_1+S_2*F_2)/(F_1+F_2).$$

This calculating method implicitly contains the accumulation of terms by the addition method.

Figure 12:
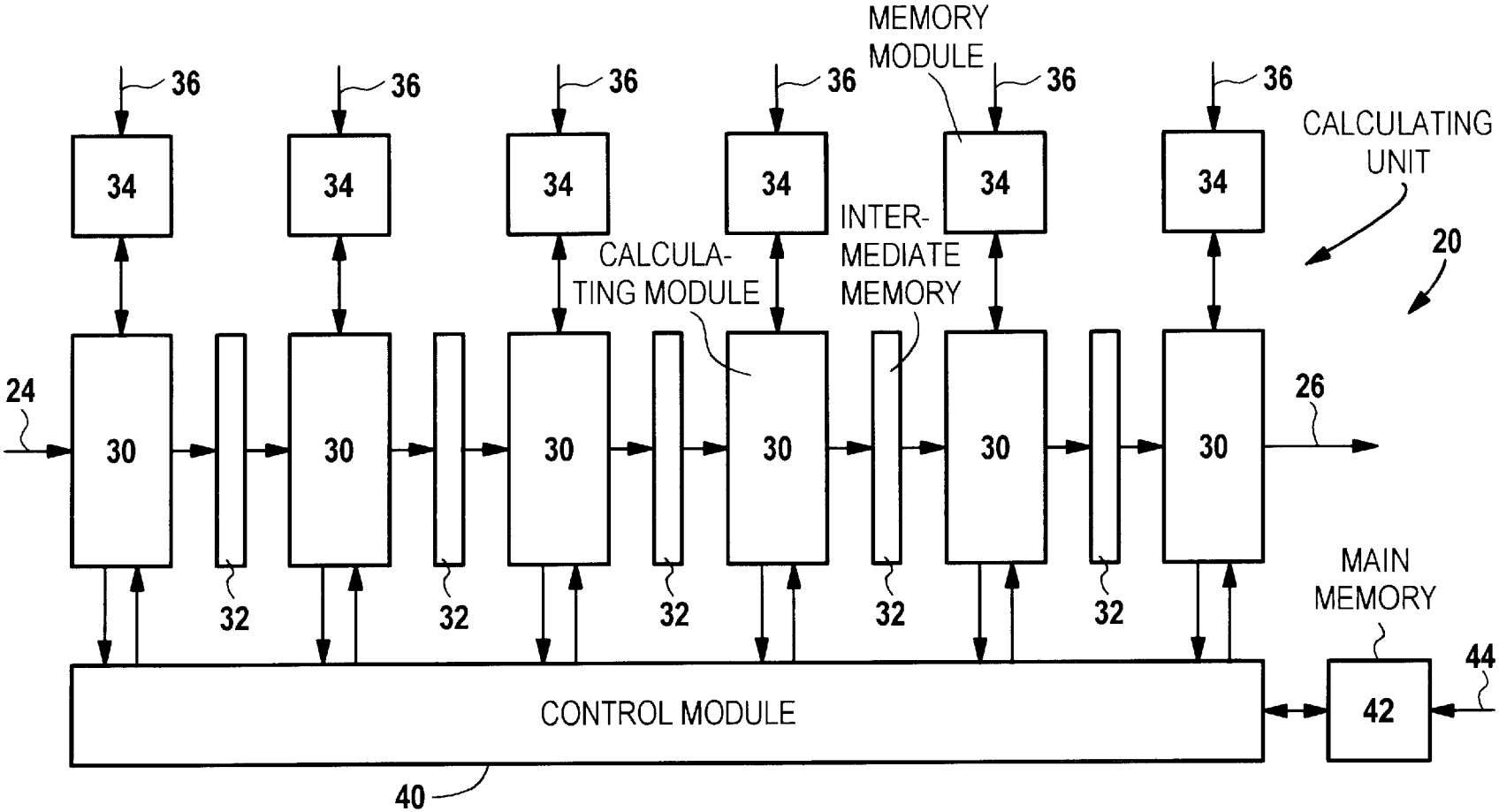
FIG. 12 is a block circuit diagram of a calculating unit in an inventive hearing aid.

FIG. 12 shows a first embodiment of the inventive calculating unit 20 that executes the described fuzzy logic functions. The calculations unit 20 contains six calculating modules 30 that are connected following one another in series over five intermediate memories 32. Further, a memory module 34 with a configuration input 36 is allocated to each calculation module 30. A control module 40 is connected to all calculation modules 30 as well as to the main memory 42, which can be accessed from the outside via a terminal 44.

One of the calculation modules 30 corresponds to each sub-function type 50, 52, 54, 56, 58 and 60 shown in FIG. 2. The first calculation module 30 receives the sharp input values as input signal 24; the last calculation module 30 outputs the calculated, sharp event values as event signal 26. The transfer of the intermediate results between the calculation modules 30 ensues via the intermediate memories 32.

The internal intermediate results can be stored in the memory module 34 allocated to each calculation module 30. Each memory module 34 can also contain configuration information for the sub-function executed by the respective calculation module 30. Such configuration information can, for example, be the membership functions of the input variables in the first calculation module 30 that receives the input signal 24. The memory modules 34 can be defined from the outside via the configuration inputs 36 for the configuration of the fuzzy logic functions of the calculation means 20.

The control module 40 coordinates the overall execution and the collaboration of the calculation modules 30. For example, the processing time can differ in the individual calculation modules 30. The task of the control module 40 is then to inform each calculation module 30 when the intermediate results of the preceding calculation model 30 are available for further-processing.

Intermediate results and configuration information can also be deposited in the main memory 42 allocated to the control module 40.

The realization of the calculation modules 30 as well as of the other components of the calculation unit 20 in digital circuit technology arises using known techniques directly from the description of the corresponding sub-functions. This can be accomplished with combinational logic systems, sequential logic systems or a combination of the two. Its exact functions can then be defined by configuration information.

The number of calculation modules 30 provided in the calculating unit 20 need not necessarily be six. More or fewer calculation modules 30 can be present in order to divide the calculation of the fuzzy logic functions more finely or more coarsely. For example, five calculation modules 30 can be utilized according to the above-described Steps 1) through 5) or only a single calculation module 30', as shown in FIG. 14.

Figure 13:
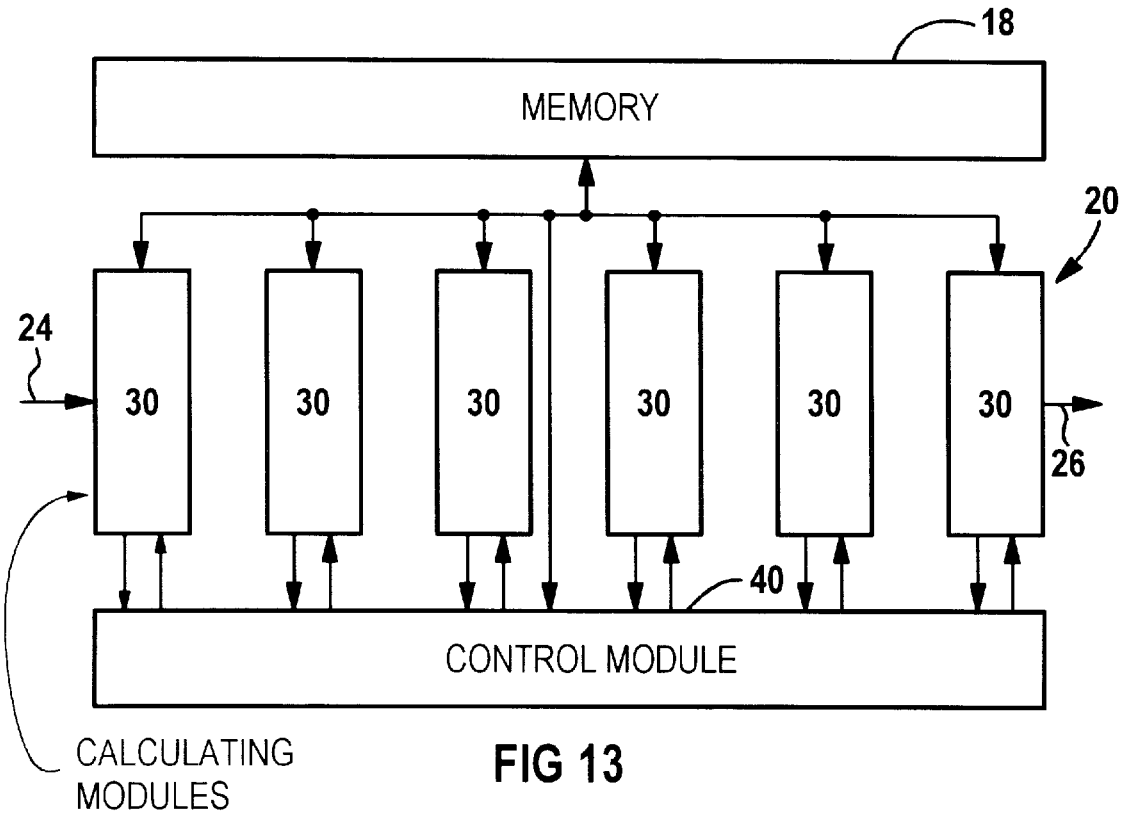
FIG. 13 is a block circuit diagram of a first alternative embodiment of the calculating unit shown in FIG. 12.

FIG. 13 shows a modified embodiment of the calculation unit 20. All intermediate memories 32 and memory modules 34 as well as the main memory 42 shown in FIG. 12 are combined here to form the single memory 18. This allows a more rational employment of the memory capacity since it can be arbitrarily partitioned and allocated to the individual modules as needed. Information required by different modules likewise need be deposited only once in the memory 18.

Figure 14:
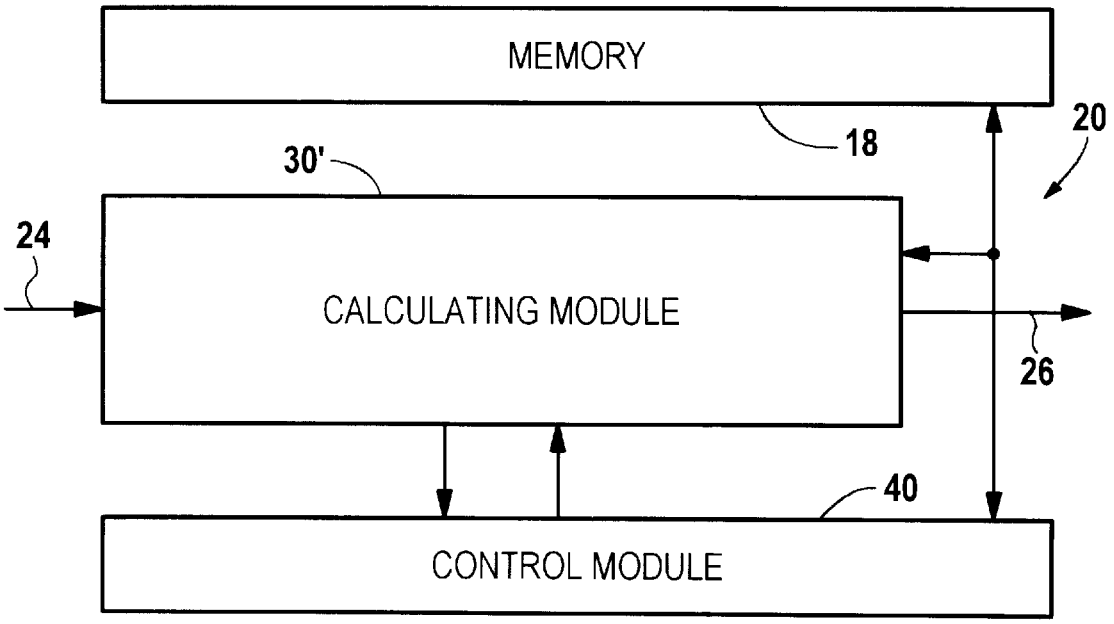
FIG. 14 is a block circuit diagram of a second alternative embodiment of the calculating unit shown in FIG. 12.

FIG. 14 shows another modified embodiment of the calculating unit 20. Here, all calculation modules 30 are combined to form a single calculation module 30'. If this calculation module 30' is additionally designed insofar as possible as a programmable operational unit, then its calculating capacity can be arbitrarily partitioned and allocated to the individual sub-functions. This assures an optimum data throughput through the overall system.

In another preferred development, the calculation modules 30 (or the calculation module 30') have access to a preferably hard-wired module for determining the minimum and/or the maximum of two or more binary numbers. This is advantageous because the formation of the minimum and of the maximum are two basic functions that occur in many fuzzy logic sub-functions.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

an input transducer, which receives an input signal, and an output transducer, said input transducer and said output transducer having a signal path therebetween traversed by said input signal;

amplifier and transmission means connected in said signal path for modifying said input signal, said amplifier and transmission means containing at least one adjustable circuit component which acts on said input signal, and said amplifier and transmission means having a signal tap at which a tapped signal is present; and digitally constructed calculating means, connected to said signal tap, for generating a control signal dependent on said tapped signal by implementing a plurality of fuzzy logic functions, including a plurality of algorithm steps, incorporating said tapped signal, and for supplying said control signal to said at least one component in said amplifier and transmission means for modifying said input signal dependent on said tapped signal said calculation means comprising a control module, at least one memory and a plurality of calculating modules equal in number to said plurality of algorithm steps, connected to said control module to said at least one memory, said algorithm steps being respectively executed in said calculating modules in an adjustable sequence controlled by said control module.

2. A hearing aid as claimed in claim 1 wherein said amplifier and transmission means includes a memory in which a plurality of different sets of amplification and transmission parameters are stored, and wherein said calculating means comprises means for generating said control signal for selecting one of said parameter sets.

3. A hearing aid as claimed in claim 1 wherein said amplifier and transmission means comprises a first part and a second part, and wherein said signal path comprises, in sequence, said first part of said amplifier and transmission means, said calculating means, and said second part of said amplifier and transmission means.

4. A hearing aid as claimed in claim 1 further comprising signal editing means, connected between said signal tap and said calculating means, for editing said tapped signal.

5. A hearing aid as claimed in claim 1 wherein said amplifier and transmission means comprises an input and an output, an analog-to-digital converter connected to said input and a digital-to-analog converter connected to said output, and a plurality of components, including said at least one component, executed completely digitally, connected between said analog-to-digital converter and said digital-to-analog converter.

6. A hearing aid as claimed in claim 1 wherein said calculating means comprises a plurality of separate memories respectively for said algorithm steps, respectively connected to said calculating modules.

7. A hearing aid as claimed in claim 1 wherein said calculating means comprises a plurality of memories connected in series alternating with said plurality of calculating modules, with one intermediate memory disposed between adjacent series-connected calculating modules.

8. A hearing aid as claimed in claim 1 wherein said plurality of calculating modules comprise a calculating module for fuzzification of sharp input variables, a calculation module for evaluation of premises, a calculating module for evaluation of sub-conclusions, a calculating module for accumulating output terms, and a calculating module for defuzzification.

9. A hearing aid as claimed in claim 8 wherein said calculating module for fuzzification of sharp input variables comprises means for employing membership functions for fuzzification of sharp input variables, said membership functions having a function value proceeding linearly between a maximum of four corner values, said corner values respectively having ordinate values selected from the group consisting of 0 and 1.

10. A hearing aid as claimed in claim 8 wherein said calculation module for accumulating output terms and said calculating module for defuzzification, in combination, comprise means for operating on a plurality of output variables simultaneously to produce an output value x according to:

$$x = \frac{\sum_{n=1}^{N} S_n * F_n}{\sum_{n=1}^{N} F_n}$$

wherein N is the number of output terms for each output variable, $F_n$ is the activated surface for the $n^{th}$ output term, and $S_n$ is the center of gravity position of the activated surface $F_n$ of the $n^{th}$ output term.

* * * * *